US010522956B2

(12) United States Patent
Lee et al.

(10) Patent No.: US 10,522,956 B2
(45) Date of Patent: Dec. 31, 2019

(54) ELECTRONIC DEVICE

(71) Applicant: PEGATRON CORPORATION, Taipei (TW)

(72) Inventors: Yi-Wei Lee, Taipei (TW); Hsien-Tsung Lee, Taipei (TW); Shih-Hao Chen, Taipei (TW)

(73) Assignee: PEGATRON CORPORATION, Taipei (TW)

( * ) Notice: Subject to any disclaimer, the term of this patent is extended or adjusted under 35 U.S.C. 154(b) by 0 days.

(21) Appl. No.: 16/129,489

(22) Filed: Sep. 12, 2018

(65) Prior Publication Data

US 2019/0097368 A1 Mar. 28, 2019

(30) Foreign Application Priority Data

Sep. 25, 2017 (CN) ..... 2017 2 1232625 U

(51) Int. Cl.
*H01R 25/00* (2006.01)
*H01R 13/24* (2006.01)
*H01R 25/14* (2006.01)

(52) U.S. Cl.
CPC ..... *H01R 25/145* (2013.01); *H01R 13/24* (2013.01); *H01R 25/142* (2013.01)

(58) Field of Classification Search
CPC ..... H01R 25/14; H01R 25/142
See application file for complete search history.

(56) References Cited

U.S. PATENT DOCUMENTS 5,429,518 A * 7/1995 Chen ..... H01R 13/71 200/51.09
5,688,132 A * 11/1997 Rogers ..... H01R 25/142 439/120
7,128,585 B2 * 10/2006 Evilsizer ..... H01R 25/14 439/120
9,444,241 B2 9/2016 Chen
10,145,545 B2 * 12/2018 Farrnbacher ..... F21V 19/001
2017/0030593 A1 * 2/2017 O'Connor ..... F24D 3/02

* cited by examiner

*Primary Examiner* — Xuong M Chung Trans
(74) *Attorney, Agent, or Firm* — J.C. Patents

(57) ABSTRACT

The present disclosure discloses an electronic device including an electronic apparatus and an electric connector. The electronic apparatus includes an electric connection port. The electric connection port includes a concave trench, a first and second conductive strips are disposed in the concave trench. The first conductive strip and the second conductive strip respectively extend along an extending direction of the concave trench. The electric connector includes a first and second elastic contacts which are exposed and protruded outward. When the electric connector is plugged into the electric connection port, the first elastic contact is in contact with the first conductive strip, and the second elastic contact is in contact with the second conductive strip. The electric connection port may accommodate the electric connector, so that the electric connector may be selectively plugged to any position on the electric connection port along the extending direction of the concave trench.

8 Claims, 5 Drawing Sheets

ELECTRONIC DEVICE

CROSS-REFERENCE TO RELATED APPLICATION

This application claims the priority benefit of China application serial no. 201721232625.6, filed on Sep. 25, 2017. The entirety of the above-mentioned patent application is hereby incorporated by reference herein and made a part of this specification.

BACKGROUND

1. Technology Field

The present disclosure generally relates to an electronic device, in particular to an electronic device with high user convenience.

2. Description of Related Art

Generally, an electric connection port of an electronic apparatus is located at a specific position, so that an electric connector (for example a charging connector) is required to be plugged to the specific position on the electronic apparatus. The electronic apparatus should be fitted to the position of the electric connector during connection to the electric connector, thus possibly making the electronic apparatus inconvenient to be used.

SUMMARY

The present disclosure is directed to provide an electronic device. An electric connection port of an electronic apparatus of the electronic device may provide a plurality of plugging positions. An electric connector may be plugged randomly along an extending direction of the electric connection port of the electronic apparatus to improve the user convenience of the electronic apparatus during charging.

In order to achieve the above-mentioned objective, an electronic device provided by the present disclosure includes an electronic apparatus and an electric connector. The electronic apparatus includes at least one electric connection port. Each of the electric connection port includes a concave trench, a first conductive strip, and at least one second conductive strip. The concave trench has a bottom surface. The first conductive strip and the at least one second conductive strip are respectively arranged in the concave trench and to extend along an extending direction of the concave trench. The first conductive strip is disposed on the bottom surface of the concave trench, and the at least one second conductive strip is disposed beside the first conductive strip and is insulated from the first conductive strip. The electric connector is detachably plugged to one of the electric connection ports, and the electric connector includes a first elastic contact and a second elastic contact both of which are exposed and protruded outward. The first elastic contact corresponds to the first conductive strip, and the second elastic contact corresponds to the at least one second conductive strip. When the electric connector is plugged into the electric connection port, the first elastic contact of the electric connector is in contact with the first conductive strip, and the second elastic contact of the electric connector is in contact with one of the second conductive strips. The electric connection port can accommodate the electric connector, and the electric connector may be selectively plugged to any position on the electric connection port along the extending direction of the concave trench.

In one embodiment of the present disclosure, the concave trench may include at least one side surface adjacent to the bottom surface, and the at least one second conductive strip may be disposed on the at least one side surface.

In one embodiment of the present disclosure, the at least one side surface may include two side surfaces, and the two side surfaces may be located on two sides of the bottom surface; the at least one second conductive strip may include two second conductive strips, and the two second conductive strips may be respectively disposed on the two side surfaces of the concave trench; the second elastic contact of the electric connector may be selectively in contact with one of the two second conductive strips.

In one embodiment of the present disclosure, the first conductive strip may be disposed in the center of the bottom surface, and the at least one second conductive strip may be disposed off center on the bottom surface of the concave trench.

In one embodiment of the present disclosure, the at least one second conductive strip may include two second conductive strips respectively disposed on two sides of the first conductive strip, and the second elastic contact of the electric connector may be selectively in contact with one of the two second conductive strips.

In one embodiment of the present disclosure, the at least one electric connection port may include a plurality of discontinuous electric connection ports.

In one embodiment of the present disclosure, the concave trenches of the electric connection ports may be equal in length.

In one embodiment of the present disclosure, the concave trenches of the electric connection ports may be different in length.

In one embodiment of the present disclosure, the first conductive strip is one of a ground lead wire and a power supply lead wire, and the at least one second conductive strip is the other one of the ground lead wire and the power supply lead wire.

In one embodiment of the present disclosure, the first elastic contact may be a pogo pin or a bent elastic sheet, and the second elastic contact may be a pogo pin or a bent elastic sheet.

Based on the above, in the present disclosure, to improve the user convenience of the electronic apparatus during charging, each electric connection port of the electronic apparatus has a relatively long size to enable the electric connector to be plugged randomly along the extending direction of the electric connection port of the electronic apparatus. The electric connection port is internally provided with the first conductive strip and the second conductive strip which extend along the extending direction of the concave trench, so that the first elastic contact of the electric connector may be in contact with the first conductive strip of the electric connection port and the second elastic contact of the electric connector may be in contact with the second conductive strip of the electric connection port to transmit power to the electronic apparatus as long as the electric connector is plugged into the electric connection port.

In order to make the aforementioned features and advantages of the present disclosure more obvious and comprehensible, embodiments accompanied with figures are described in detail below.

DESCRIPTION OF THE EMBODIMENTS

Figure 1:
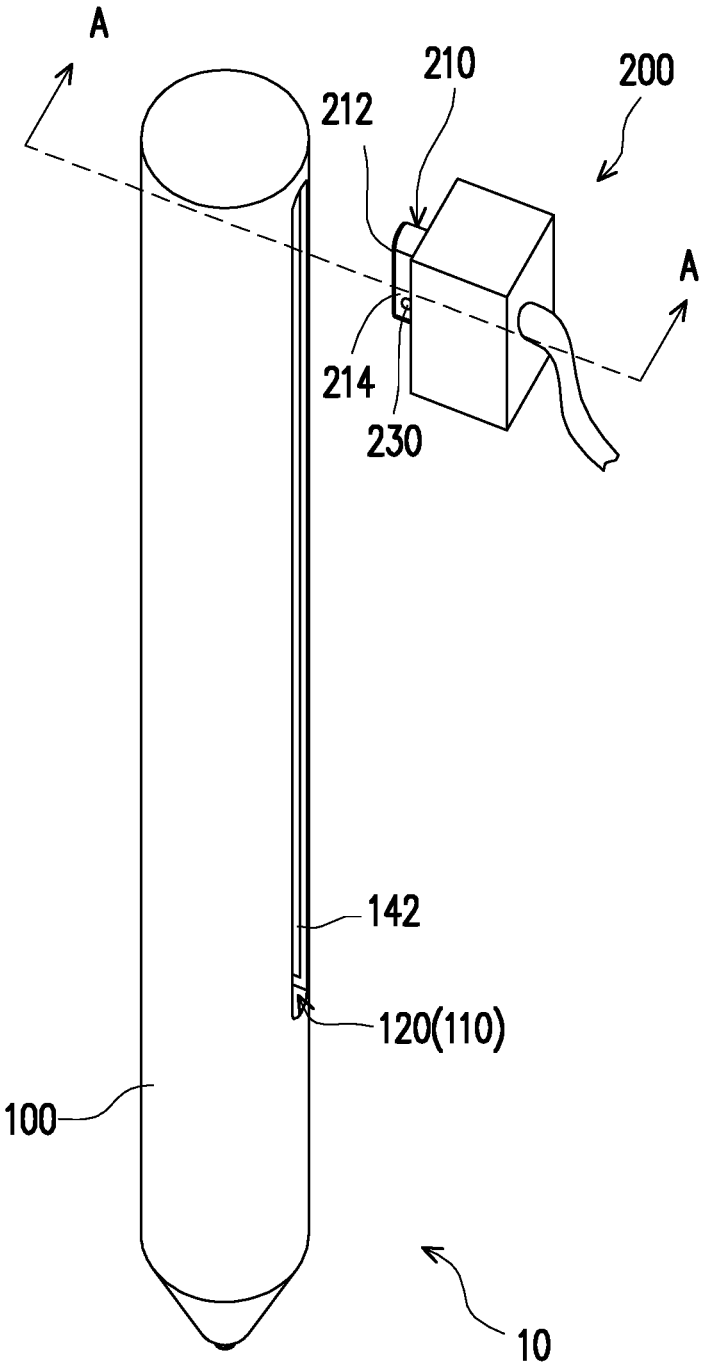
FIG. 1 is a three-dimensional schematic diagram of an electronic device according to one embodiment of the present disclosure.

FIG. 1 is a three-dimensional schematic diagram of an electronic device according to one embodiment of the present disclosure. Please refer to FIG. 1. The electronic device 10 includes an electronic apparatus 100 and an electric connector 200. In the present embodiment, the electronic apparatus 100 takes a stylus for example, but is not limited to this type. In other embodiments, the electronic apparatus 100 may be a mobile phone, a tablet computer, a notebook computer, a mouse, or other electronic apparatus 100. The electric connector 200, for example, may be used for charging the electronic apparatus 100 or transmitting a signal. Part of a transmission line of the electric connector 200 is omitted in FIG. 1. Actually, the transmission line of the electric connector 200 may be possibly connected to another connector (not shown).

In the present embodiment, the electronic apparatus 100 includes an electric connection port 110 electrically connected to the electric connector 200. It can be obviously seen in FIG. 1 that the length of the electric connection port 110 is greater than that of a portion, which is to be plugged into the electric connection port 110, in the electric connector 200, namely, the electric connection port 110 can accommodate the electric connector 200. The electronic device 10 of the present embodiment makes use of this feature, so that the electric connector 200 can be selectively plugged into any position on the electric connection port 110 along an extending direction (which is an up-down direction in the present disclosure) of a concave trench 120. For example, the electric connector 200 is plugged into the uppermost end, the middle region, or the bottom end of the electric connection port 110. That is, the electric connector 200 is plugged into a first position of the electric connection port 110 such as the uppermost end of the electric connection port 110. The electric connector 200 is plugged into a second position of the electric connection port 110 such as the middle region or the bottom end of the electric connection port 110. Thus, the electric connector 200 can be plugged into the electric connection port 110 of the electronic apparatus 100 more freely to improve the user convenience of the electronic apparatus 100 during charging.

Figure 2:
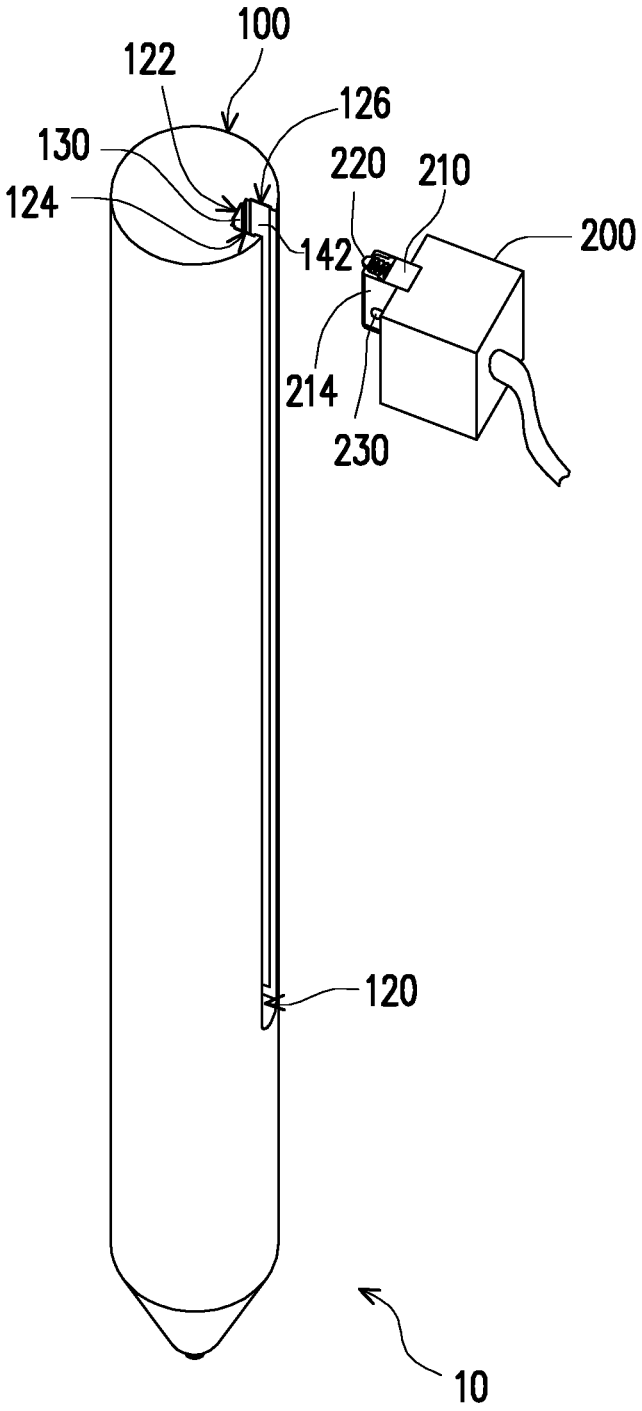
FIG. 2 is a three-dimensional schematic diagram of the electronic device taken along a line A-A of FIG. 1.
Figure 3:
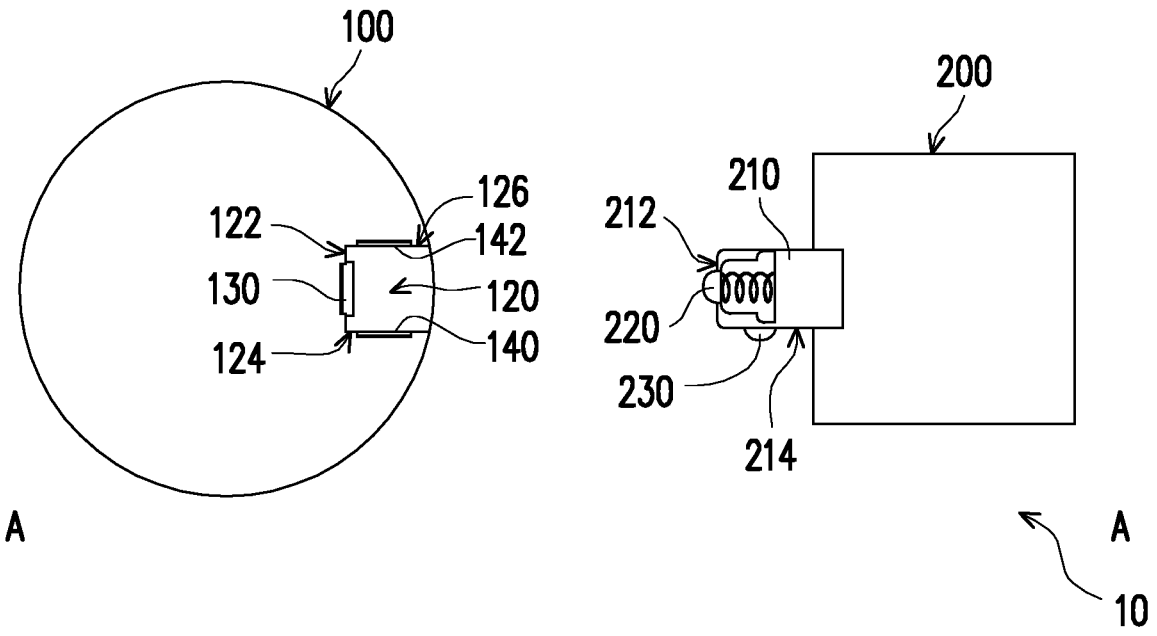
FIG. 3 is a cross-sectional view of the electronic device along the A-A line segment of FIG. 1.

FIG. 2 is a three-dimensional schematic diagram of the electronic device taken along a line A-A of FIG. 1. FIG. 3 is a cross-sectional view of the electronic device along the A-A line segment of FIG. 1. Please refer to FIG. 2 and FIG. 3. The electric connection port 110 (as shown in FIG. 1) includes a concave trench 120, a first conductive strip 130 and at least one second conductive strip 140 or 142 both of which are located in the concave trench 120. In the present embodiment, the electric connection port 110 includes two second conductive strips 140, 142. The first conductive strip 130 and the second conductive strips 140, 142 extend respectively along an extending direction of the concave trench 120. The concave trench 120 includes a bottom surface 122 and two side surfaces 124, 126 located on two sides of the bottom surface 122. The first conductive strip 130 is disposed on the bottom surface 122, and the two second conductive strips 140, 142 are respectively disposed on the two side surfaces 124, 126.

In addition, the first conductive strip 130 is insulated from the second conductive strips 140, 142. In the present embodiment, the first conductive strip 130 is one of a ground lead wire and a power supply lead wire, and the second conductive strips 140, 142 are the other one of the ground lead wire and the power supply lead wire. Of course, in other embodiments, one of the first conductive strip 130 and the second conductive strips 140, 142 also may be a signal lead wire. The first conductive strip 130 and the second conductive strips 140, 142 are not limited to these types.

In the present embodiment, the electric connector 200 is detachably plugged into the electric connection port 110 and includes an insulating body 210, a first elastic contact 220, and a second elastic contact 230 which are exposed and protruded from the insulating body 210. The insulating body 210 includes a body bottom surface 212 and a body side surface 214 connected to the body bottom surface 212. In the present embodiment, the first elastic contact 220 protrudes from the body bottom surface 212 in a retractable manner, and the second elastic contact 230 protrudes from the body side surface 214 in a retractable manner. In the present embodiment, the first elastic contact 220 and the second elastic contact 230 take pogo pins as examples, but the first elastic contact 220 and the second elastic contact 230 are not limited to this type.

As shown in FIG. 3, the first elastic contact 220 of the electric connector 200 corresponds to the first conductive strip 130 of the electric connection port 110, and the second elastic contact 230 of the electric connector 200 may correspond to the second conductive strip 140 of the electric connection port 110. Accordingly, when the electric connector 200 is plugged into the electric connection port 110, the first elastic contact 220 of the electric connector 200 is in contact with the first conductive strip 130, and the second elastic contact 230 of the electric connector 200 is in contact with the second conductive strip 140, so as to realize electric conduction.

It is worth mentioning that in the present embodiment, the two second conductive strips 140, 142 of the electric connection port 110 are respectively disposed on the two side surfaces 124 and 126 of the concave trench 120, so that the second elastic contact 230 of the electric connector 200 is selectively in contact with one of the two second conductive strips 140, 142. In detail, a user may further turn over the electric connector 200 upside down by 180 degrees to turn the second elastic contact 230 to the top to correspond to the second conductive strip 142 located above, and then plug the electric connector 200 into the electric connection port 110 in addition to directly plugging the electric connector 200 leftwards into the electric connection port 110 along a direction as shown in FIG. 3 to enable the first elastic contact 220 of the electric connector 200 to be in contact with the first conductive strip 130 of the electric connection port 110 and enable the second elastic contact 230 of the electric connector 200 to be in contact with the second conductive strip 140 of the electric connection port 110. At this time, when the first elastic contact 220 of the electric connector 200 is in contact with the first conductive strip 130 of the electric connection port 110, and the second elastic contact 230 of the electric connector 200 is in contact with the second conductive strip 142 of the electric connection port 110, the electric conduction function also may be realized in the same way.

The conventional electric connector has to be plugged into the electric connection port of the conventional electronic apparatus 100 only along one direction, resulting in a limitation to the arrangement direction of the conventional electronic apparatus 100 during charging. However, the electric connector 200 of the present embodiment may be forwardly or backwardly plugged into the electric connection port 110 of the electronic apparatus 100 to provide more choices for connection.

It should be noted that during use of the electronic device 10 of the present embodiment, the electric connector 200 may slide along the electric connection port 110 randomly as the user moves the electronic apparatus 100. In this process, the first elastic contact 220 of the electric connector 200 is in contact with the first conductive strip 130 of the electric connection port 110, and the second elastic contact 230 of the electric connector 200 is in contact with the second conductive strip 140 or 142 of the electric connection port 110, so that electric connection can be kept. Alternatively, the electronic device 10 of the present embodiment may also use the first elastic contact 220 and the second elastic contact 230 which are not easy to deform (for example, the elastic coefficients of internal springs are relatively large) according to demands, so as to enable the first elastic contact 220 and the second elastic contact 230 to abut against the first conductive strip 130 and the second conductive strip 140 or 142 of the electric connection port 110. In this way, the electric connector 200 is basically fixed at the original plugging position on the electric connection port 110 instead of sliding along with the movement of the electronic apparatus 100 unless the user exerts a relatively great force to move the electric connector 200.

Other embodiments are described below. Elements identical with or similar to those in the aforementioned embodiment are expressed by identical or similar numerals, and the descriptions thereof are omitted. Only main differences between different embodiments are described below.

Figure 4:
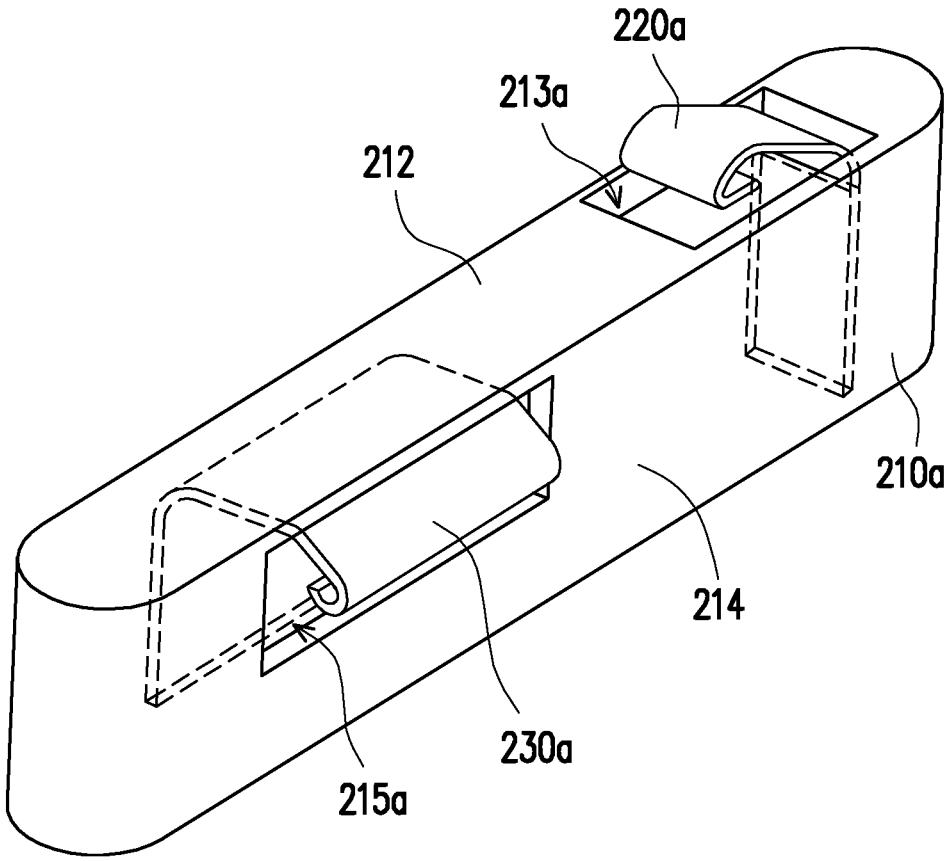
FIG. 4 is a partially three-dimensional schematic diagram of an electric connector according to another embodiment of the present disclosure.

FIG. 4 is a partially three-dimensional schematic diagram of an electric connector according to another embodiment of the present disclosure. Please refer to FIG. 4. In the present embodiment, the first elastic contact 220*a* and the second elastic contact 230*a* take bent elastic sheets as examples. The first elastic contact 220*a* and the second elastic contact 230*a* are buried in the body bottom surface 212 and the body side surface 214 of the insulating body 210*a*. The insulating body 210*a* is provided with corresponding grooves 213*a*, 215*a* at the body bottom surface 212 and the body side surface 214, respectively. When the electric connector is plugged into the electric connection port 110 (as shown in FIG. 3), the first elastic contact 220*a* and the second elastic contact 230*a* may retract inside, so that the grooves 213*a* and 215*a* may provide spaces for the retraction of the first elastic contact 220*a* and the second elastic contact 230*a*.

Figure 5:
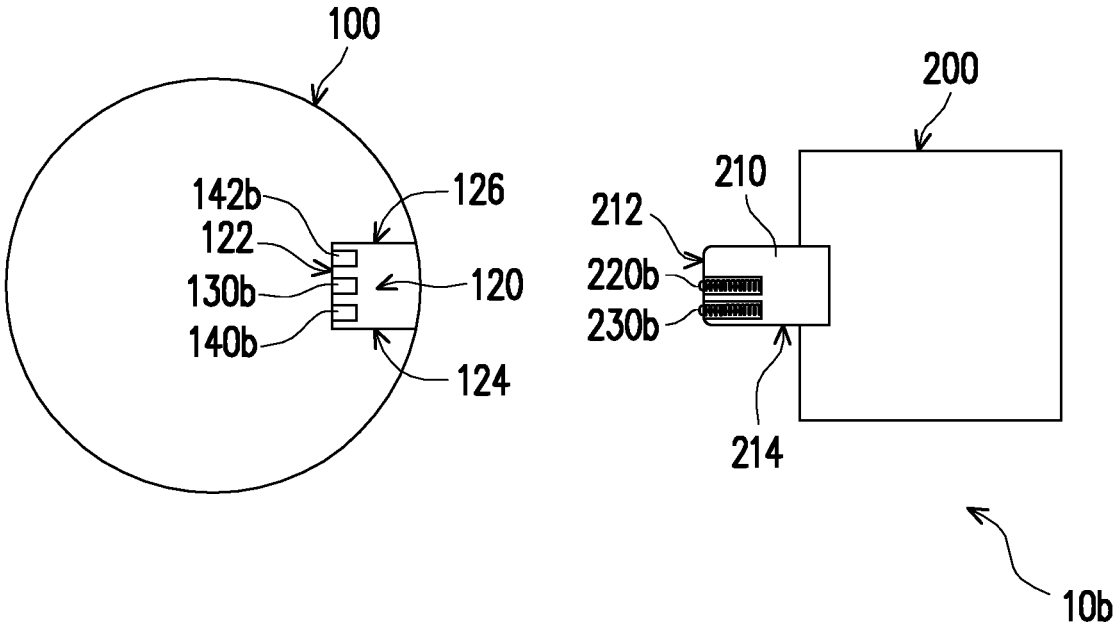
FIG. 5 is a cross-sectional view of an electronic device according to another embodiment of the present disclosure.

FIG. 5 is a cross-sectional view of an electronic device according to another embodiment of the present disclosure. Please refer to FIG. 5. A main difference between the embodiment of FIG. 5 and the embodiment of FIG. 3 is the position in the concave trench 120 where the second conductive strips 140, 142, 140*b* and 142*b* are disposed and the position on the insulating body 210 where the second elastic contacts 230 and 230*b* are disposed. As shown in FIG. 3, the second conductive strips 140, 142 of the electric connection port 110 are disposed on the side surfaces 124 and 126 of the concave trench 120, and the second elastic contact 230 of the electric connector 200 is disposed on the body side surface 214 of the insulating body 210.

In FIG. 5, the second conductive strips 140*b* and 142*b* and the first conductive strip 130*b* are disposed on the bottom surface 122 of the concave trench 120 together. The first conductive strip 130*b* is disposed in the center of the bottom surface 122, and the second conductive strips 140*b* and 142*b* are disposed off center on the bottom surface 122. For example, the second conductive strips 140*b* and 142*b* are located on two sides of the first conductive strip 130*b*. The second elastic contact 230*b* of the electric connector 200 and the first elastic contact 220*b* are disposed on the body bottom surface 212 of the insulating body 210 together. The first elastic contact 220*b* is disposed in the center of the body bottom surface 212, and the second elastic contact 230*b* is disposed off center on the body bottom surface 212. For example, the second elastic contact 230*b* can be located on the two sides of the first elastic contact 220*b*. In the present embodiment, the second elastic contact 230*b* of the electric connector 200 also may be selectively in contact with one of the two second conductive strips 140*b* and 142*b* in the same way, so as to provide forward and backward plugging functions.

Of course, in other embodiments, the electric connection ports also may be provided with more second conductive strips respectively disposed on the bottom surface 122 and the side surfaces 124, 126 of the concave trench 120, and the electric connector also may be provided with more second elastic contacts respectively disposed on the body bottom surface 212 and the body side surface 214 of the insulating body 210. Provided that these second conductive strips in the electric connection port are symmetrically disposed about the first conductive strip, and these second elastic contacts on the electric connector are symmetrically disposed about the first elastic contact, the forward and backward plugging functions may be also provided in the same way.

Figure 8:
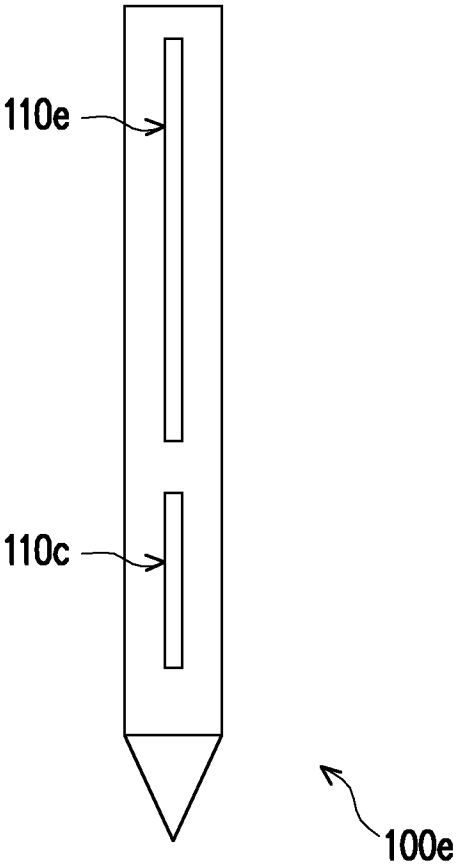
FIGS. 6 to 8 are schematic diagrams of electronic devices according to other embodiments of the present disclosure.
Figure 7:
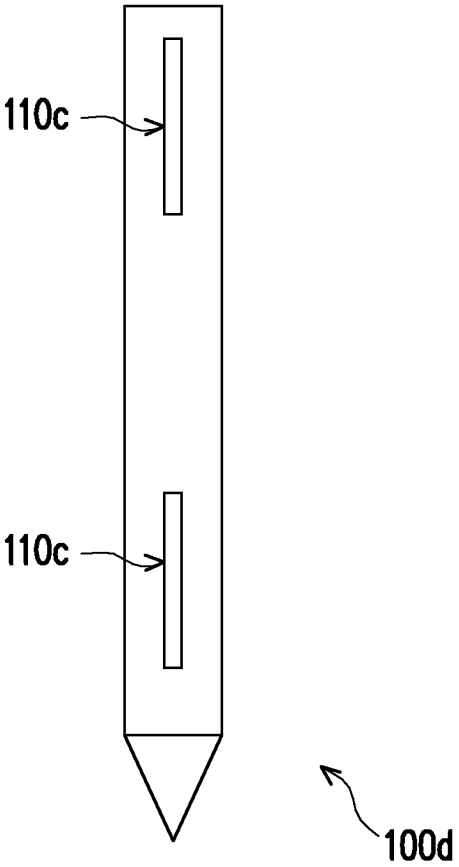
Figure 6:
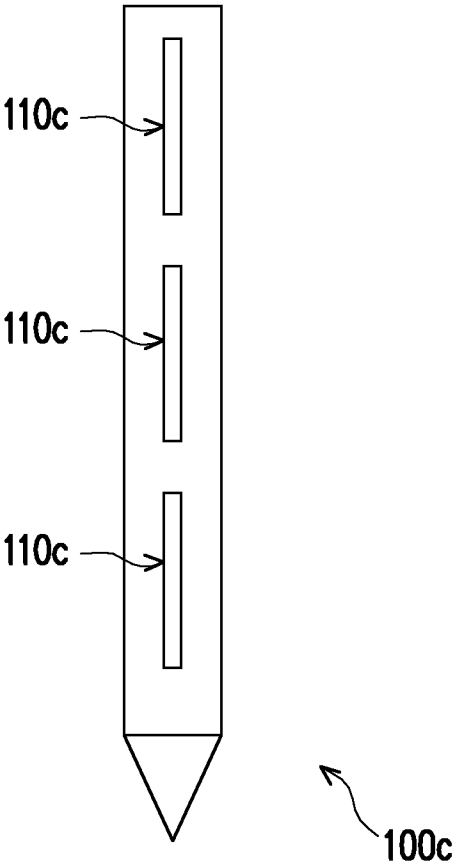

FIG. 6 to FIG. 8 are schematic diagrams of electronic apparatuses according to other embodiments of the present disclosure. Please refer to FIG. 6 and FIG. 7 at first. Main differences between the electronic apparatuses 100*c* and 100*d* of FIG. 6 and FIG. 7 and the electronic apparatus 100 of FIG. 1 are that in FIG. 1, the electronic apparatus 100 is only provided with one electric connection port 110. In FIG. 6 and FIG. 7, the electronic apparatuses 100*c* and 100*d* include a plurality of discontinuous electric connection ports 110*c*. That is to say, when FIG. 6 is compared with FIG. 1, the main difference is the number and the length of the electric connection ports 110 and 110*c*. When FIG. 7 is compared with FIG. 6, the main difference is the number and the positions of the electric connection ports 110*c*.

Please refer to FIG. 8. A main difference between the electronic apparatus 100*e* of FIG. 8 and the electronic apparatus 100*d* of FIG. 7 is that in FIG. 7, these electric connection ports 110*c* are equal in length. In FIG. 8, these electric connection ports 110*c* and 110*e* are different in length. In other words, the position, the number and the length of the electric connection port of the electronic apparatus all may be in different designs as required, so as to provide different usage experiences for the user.

It should be noted that each of the electric connection ports 110*c* and 110*e* of FIG. 6 to FIG. 8 may be internally provided with configuration of the first conductive strip 130 and the second conductive strips 140 and 142 the same as that of the electric connection port 110 of FIG. 1, and the descriptions thereof are omitted herein.

Based on the above, in the embodiment of the present disclosure, to improve the user convenience of the electronic apparatus during charging, each electric connection port of the electronic apparatus has a relatively long size to enable the electric connector to be plugged randomly along the extending direction of the electric connection port of the electronic apparatus. The electric connection port is internally provided with the first conductive strip and the second conductive strip which extend along the extending direction of the concave trench, so that the first elastic contact of the electric connector may be in contact with the first conductive strip of the electric connection port and the second elastic contact of the electric connector may be in contact with the second conductive strip of the electric connection port to transmit power to the electronic apparatus as long as the electric connector is plugged into the electric connection port.

The above embodiments cooperatively disclose the present disclosure, but not intended to limit the present disclosure. Any person of ordinary skill in the art can make some variations and embellishments without departing from the spirit and scope of the present disclosure, so that the protection scope of the present disclosure shall be based on that defined by appended claims.

What is claimed is:

1. An electronic device, comprising:

an electronic apparatus including at least one electric connection port, each of the electric connection port including a concave trench, a first conductive strip, and two second conductive strips respectively disposed on two sides of the first conductive strip, the concave trench having a bottom surface, the first conductive strip and the two second conductive strip being respectively arranged in the concave trench and to extend along an extending direction of the concave trench, wherein the first conductive strip is disposed in the center of the bottom surface of the concave trench, and the two second conductive strip is disposed off center on the bottom surface of the concave trench and beside the first conductive strip and is insulated from the first conductive strip; and an electric connector detachably plugged to one of the at least one electric connection port and including a first elastic contact and a second elastic contact both of which are exposed and protruded outward, the first elastic contact corresponding to the first conductive strip, the second elastic contact corresponding to the two second conductive strip, wherein when the electric connector is plugged into the electric connection port, the first elastic contact of the electric connector is in contact with the first conductive strip, and the second elastic contact of the electric connector may be selectively in contact with one of the two second conductive strip, wherein the electric connection port may accommodate the electric connector, and the electric connector may be selectively plugged to any position on the electric connection port along the extending direction of the concave trench.

2. The electronic device according to claim 1, wherein the concave trench comprises at least one side surface adjacent to the bottom surface, and the two second conductive strip is disposed on the at least one side surface.

3. The electronic device according to claim 2, wherein the at least one side surface comprises two side surfaces, the two side surfaces are located on two sides of the bottom surface, the two second conductive strips are respectively disposed on the two side surfaces, and the second elastic contact of the electric connector is selectively in contact with one of the two second conductive strips.

4. The electronic device according to claim 1, wherein the at least one electric connection port comprises a plurality of discontinuous electric connection ports.

5. The electronic device according to claim 4, wherein the plurality of concave trenches of the plurality of electric connection ports are equal in length.

6. The electronic device according to claim 4, wherein the plurality of concave trenches of the plurality of electric connection ports are different in length.

7. The electronic device according to claim 1, wherein the first conductive strip is one of a ground lead wire and a power supply lead wire, and the two second conductive strip is the other one of the ground lead wire and the power supply lead wire.

8. The electronic device according to claim 1, wherein the first elastic contact is a pogo pin or a bent elastic sheet, and the second elastic contact is a pogo pin or a bent elastic sheet.

* * * * *